United States Patent [19]

Pelofsky et al.

[11] 4,003,820

[45] Jan. 18, 1977

[54] SHORT RESIDENCE TIME HYDROPYROLYSIS OF CARBONACEOUS MATERIAL

[75] Inventors: Arnold H. Pelofsky, East Brunswick; Marvin Greene, Somerset, both of N.J.

[73] Assignee: Cities Service Company, Tulsa, Okla.

[22] Filed: Oct. 7, 1975

[21] Appl. No.: 620,468

[52] U.S. Cl. ..... 208/8; 208/11 R; 208/142

[51] Int. Cl.[2] ..... C10G 1/02

[58] Field of Search ..... 208/8, 11 R, 142

[56] References Cited

UNITED STATES PATENTS

| | | | |
|---|---|---|---|
| 3,030,297 | 4/1962 | Schroeder | 208/8 |
| 3,111,395 | 11/1963 | Sweeney | 208/8 |
| 3,839,186 | 10/1974 | Berger | 208/8 |
| 3,855,070 | 12/1974 | Squires | 208/8 |

*Primary Examiner*—Delbert E. Gantz
*Assistant Examiner*—James W. Hellwege
*Attorney, Agent, or Firm*—John W. Carpenter

[57] ABSTRACT

A process for treating carbonaceous material with hydrogen including adding the carbonaceous material into a first reaction zone of a reactor having at least two reaction zones; adding hot hydrogen to the stream of carbonaceous material to effect a reaction with same to produce reaction products; quenching the mixture while insuring that the total residence time varies from about 2 milliseconds to about 2 seconds; removing at least a portion of the reaction products from the quenched mixture; and introducing the residual carbonaceous material into a subsequent reaction zone and repeating the steps for the subsequent reaction zone.

11 Claims, 1 Drawing Figure

DISTILLATION-HYDROGENATION REACTOR (DHR) FOR SRT HYDROPYROLYSIS OF COAL

SHORT RESIDENCE TIME HYDROPYROLYSIS OF CARBONACEOUS MATERIAL

BACKGROUND OF THE INVENTION

1. Field of the Invention

This invention relates to coal hydrogenation. More particularly, it relates to a process for treating coal with hydrogen, in the absence of added catalyst and/or solvent, to obtain a maximum of desirable liquid hydrocarbon in a minimum of gaseous and polymerize products. The utility of the invention resides in the production of desirable hydrocarbons from coal.

2. Description of the Prior Art

Processes for treating coal with hydrogen have been known for many years. Prior art references include U.S. Pat. Nos. 2,658,861; 2,832,724; 3,030,297; and 3,152,063. Typically, these processes have mixed crushed coal with various solvents, with or without added catalyst, and have heated the mixture to reaction temperature, for an extended period of time, in the presence or absence of hydrogen. Such processes have generally given a wide range of products, from gases to light hydrocarbons to high-boiling liquids, in addition to the solid residues. For example, U.S. Pat. No. 3,823,084, issued to W.C. Schroeder on July 9, 1974, discloses mixing coal and hydrogen, in the absence of a solvent, passing the mixture through a bed of hydrogenation catalyst, and recovering liquid and gaseous hydrocarbon products from the product stream. The disadvantages of such processes include addition of a catalyst that will survive the severe reaction conditions, removal of the catalyst from the effluent stream, recovery of a broad spectrum of gaseous, low-boiling and high-boiling liquids, the necessity for solvent addition and removal, and additional processing steps to separate, remove and recycle various portions of the reaction stream.

SUMMARY OF THE INVENTION

It is therefore an object of this invention to provide a process for short residence time hydropyrolysis of coal.

It is another object of this invention to provide a process for short residence time hydropyrolysis of coal which doesn't include the disadvantages of the prior art.

Still other objects will be apparent to those skilled in the art from the following description of this invention.

The foregoing objects are achieved according to the practice of this invention. Broadly, this invention comprises a process for treating carbonaceous material with hydrogen, in the absence of added catalyst, which includes, in serial combination, the following steps: adding liquid or crushed solid carbonaceous material into a first reaction zone of a reactor having at least two reaction zones; adding hot hydrogen to the stream of carbonaceous material to affect a reaction with same to produce reaction products; quenching the mixture while insuring that the total residence time varies from about 2 milliseconds to about 2 seconds; removing at least a portion of the reaction products from the quenched mixture; and introducing the residual carbonaceous material into a subsequent reaction zone and repeating the foregoing steps for the subsequent reaction zone. The process, involving short heat-up and quenched times, results in improved yields of desirable products, no problems of catalyst addition or removal, simplified apparatus, and improved process reliability.

In a narrower aspect, this invention comprises a process for converting coal into liquid hydrocarbons which includes the following steps: introducing in a continuous stream finely divided coal into a first reaction zone of a pressure vessel having at least two reaction zones; continuously adding hot hydrogen to the first reaction zone of the pressure vessel so as to impinge the coal stream and effect a reaction with same to produce fluid hydrocarbon reaction products; limiting contact between the hydrogen and coal stream within the first reaction zone of the vessel to a period of less than 2 seconds; subsequently quenching the hot hydrogen-coal stream within the first reaction zone with cold hydrogen or other coolant removing at least a portion of the fluid hydrocarbons from the quenched hydrocarbon-coal stream; and introducing the residual coal to a subsequent reaction zone and repeating the steps for the subsequent reaction zone. The separated fluid product stream can then be processed further. The heart of the invention resides in a concept of a short total residence time of the carbonaceous material in each reaction zone of the reactor; this residence time includes heat-up, reaction, and quenched times. This short residence time contrasts sharply with other high pressure hydrogenation processes involving catalyst and solvents wherein relatively long residence times are involved and the reaction mixture is quenched outside the reactor.

These, together with various ancillary objects and features which will become apparent as the following description precedes are obtained by this novel process, a preferred schematic embodiment is shown in the accompanying drawings, by way of example only wherein:

DETAILED DESCRIPTION OF THE INVENTION

Figure 1:
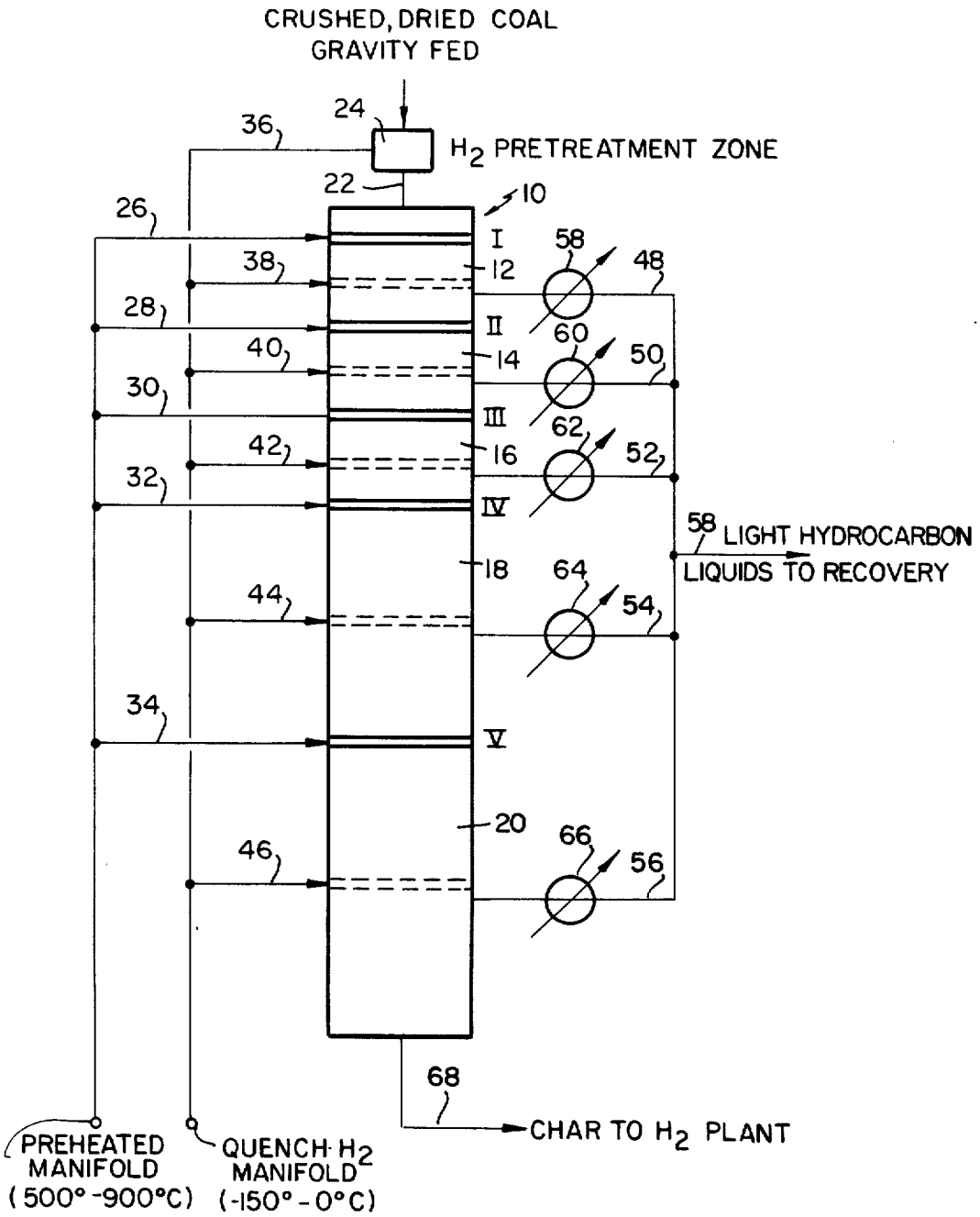
FIG. 1 is a schematic drawing of a distillation hydrogenation reactor for performing short residence time hydropyrolysis of carbonaceous material.

With continuing reference to the drawing wherein similar parts of the invention are identified by the same reference numeral, reactor, generally illustrated as 10, having (at least two) reaction zones 12, 14, 16, 18 and 20, has carbonaceous feed material fed thereto via conduit 22 after passing through a pretreatment zone 24. Hot hydrogen is added to reaction zones 12, 14, 16, 18 and 20 through conduits 26, 28, 30, 32, and 34, respectively. Quenching material is fed to pretreatment zone 24 through conduit 36, and is additionally fed to reaction zones 12, 14, 16, 18 and 20 via conduits 38, 40, 42, 44, and 46, respectively. Light hydrocarbon fluids exit reaction zones 12, 14, 16, 18 and 20 through lines 48, 50, 52, 54 and 56, respectively, and are subsequently processes via conduit to recovery. Flow meters 58, 60, 62, 64 and 66 are respectively situated on lines 48, 50, 52, 54 and 56 to gauge the flow of the light hydrocarbons products. Char is recovered through conduit 68.

Feed material for the process broadly includes carbonaceous material, exemplified by coal, lignite, peat, oil shale, tar sands, organic waste, Orinoco tar, gilsonite, and crude oil. A preferred embodiment of the invention uses coal as the solid feed material. It is noted that all of these feed materials, except conventional crude oil, are solids at ambient temperatures.

The solid feed material is crushed to a particle size of less than 1 inch. It is preferred that the particle size be less than about one-half inch, and the most preferred particle size is in the range of 50 to 325 mesh (U.S. Sieve).

The process can utilize almost any hydrogen stream as long as the hydrogen content of the stream is sufficient to react with the carbonaceous material and does not contain deleterious components. Broadly, the incoming hydrogen stream for each reaction zone can vary from about 30% hydrogen to about 100% hydrogen, based on the partial pressure of hydrogen. Since recycle of a portion of the effluent gas stream is contemplated in the process, the reactant hydrogen stream can also contain components such as methane, propane, and ethane, with these components typically not condensing as they are cooled to quench temperatures.

Since the process involves the mixing and reaction of carbonaceous material and feed hydrogen in each of the reaction zones 12, 14, 16, 18 and 20, the hydrogen-to-carbonaceous material weight ratio is an important consideration. Broadly, this weight ratio in each of the reaction zones can vary from about 0.05 to about 4, with the higher value showing an excess of hydrogen and the lower value resulting in the formation of more char, with reduced amounts of desirable product. A more desirable hydrogen-to-carbonaceous material weight ratio in each of the reaction zones is in the range of from about 0.12 to about 2, and the most preferred ratio is from about 0.6 to about 1.2.

Coal enters reactor 10 through conduit 22 after having been in pretreatment zone 24 and falls by gravity through reaction zones 12, 14, 16, 18, and 20, in order stated. The amount of residence time in each reaction zone depends on the size of the coal particles entering the reactor 10- the larger particles spend less time in each reaction zone because of their tendency to fall faster through each zone. Each reaction zone comprises hot hydrogen which has been injected into the coal stream to effect a reaction with same to produce light hydrocarbon fluids reaction products. Light hydrocarbon fluids that initially form during short residence time hydropyrolysis of coal adhere to the coal particle surfaces. If these hydrocarbons are not removed rapidly they will polymerize on the coal surface to form heavy coal tars. The stepwise removal of these hydrocarbons can be carried out in any one of the following reactors: free fall having reaction zones superimposed, dispersed phase reactor, or transport reactor. In a preferred embodiment of the invention the reactor is of the free fall type of FIG. 1. Preferably, each reaction zone quenches with hydrogen at a temperature below ° C. As was previously mentioned, conduits 38, 40, 42, 44, and 46 carry quenching hydrogen to each of the respective reaction zones. Each reaction zone additionally has communicating therewith a line (i.e. either 48, 50, 52, 54 and 56) to remove the hydrocarbon fluids after quenching. The residual coal continues to fall into a succeeding reaction zone wherein another heating, quenching and recovery step is performed. As previously mentioned, this stepwise removal is necessary to prevent polymerization of these hydrocarbons on the coal particles. The number of preheating and quenching steps (i.e. stages) will depend on the size and type of coal, reaction temperature and pressure. In a preferred embodiment of FIG. 1, it has been calculated that about preferably 20 milliseconds reaction time (coal residence time) is required for each preheat/quench stage. The reactor length between each preheat and quench stage can then be chosen to generate a reactor system with the specified residence time required for a given conversion and selectivity.

Since an important aspect of this invention resides in the rapid heating and cooling of the reactants and reaction mixture, respectively, the temperature of the incoming reactants is of some importance. Typically, the temperature of the incoming carbonaceous material is desirably less than 350° C. It is recognized that, due to conduction, radiation and convection from the hot reactor, the incoming feed material may be heated somewhat. Any tendency to overheat the material to near reaction temperatures can be reduced by various designs to cool the feed material or to move it at such a rate that it does not have time to be heated appreciably.

Hydrogen pretreatment zone 24 is provided to promote intimate contact of the coal surfaces with hydrogen prior to thermal treatment which initiates the hydrogenation and/or devolatilization reactions. This should assure that if the free radical, polymerization precursors were to exist instantaneously in the pores of the coal upon devolatilization, hydrogen will be onmipresent to stabilize the radicals and hence prevent polymerization.

Prior art processes raise the temperature of the reactants comparatively slowly, such as by using preheaters for the reacting mixture or by heating the reactor externally. Our process is based on heating the reactant hydrogen to above the reaction temperature and then rapidly impinging this hot hydrogen onto the incoming carbonaceous feed material, within each reaction zone of the reactor 10.

The temperature of the incoming hot hydrogen within each reaction zone will vary somewhat, depending on the desired hydrogen-to-carbonaceous material weight ratio of the reactant mixture and upon the desired reaction temperature within each reaction zone in the reactor. Typically the inlet hydrogen temperature within each reaction zone should be approximately 50° C. higher than the reaction temperature, when the hydrogen-to-carbonaceous material ratio is around 1, with this temperature difference resulting in a rapid heat-up time between about 500° C. per second and 100,000° C per second.

To overcome the reactor pressure, both the carbonaceous material and the incoming hydrogen within each reaction zone must be fed in at a pressure exceeding that of the reactor. Suitable mechanical arrangements, such as a staged pressure or pressurized hopper or star feeder, or pneumatic feeding devices, are available for feeding the carbonaceous material into the pressurized reactor. Cooling coils in the carbonaceous material inlet line may be combined with the mechanical arrangements to reduce the tendency to pre-heat the incoming carbonaceous material. Once the carbonaceous material enters the reactor 10 of FIG. 1 it falls by gravity or entrainment through each of the reacton zones. In a preferred arrangement of reaction zones, said zones are superimposed with respect to each other. Similarly, the pressure of the incoming hydrogen within each reaction zone will exceed that of the reactor. The combination of a slight excess of incoming hydrogen pressure and the weight of the incoming carbonaceous material results in a continuous mass flow of reactants through the reactor.

The reaction temperature within each reaction zone can vary from about 400° to about 2000° C., with a preferable range being from about 500° to about 1500° C., and a most preferred range of from about 600° C. to about 1000° C. The reactor pressure can vary from about 500 to about 5000 psig, preferably from about 600 to 4000 psig. The total residence time of the reactants in each reaction zone of the reactor can vary from about 2 milliseconds to about 2 seconds, preferably from about 5 milliseconds to about 1 second, with a most preferred residence time of from 10 milliseconds to about 900 milliseconds. As was previously mentioned, residence time primarily depends on the size of the particles of the carbonaceous material (i.e. coal) entering into the first reaction zone of the reactor 10.

This total residence time includes the heatup, reaction and quench times. Since there is reaction between the carbonaceous material and feed hydrogen as soon as the feed materials enter each reaction zone of the reactor and are mixed, and since this reaction continues until the quenched mixture exits the reactor, it is difficult to separate the various phases of the total residence time. It is implicit in the invention that the rates of heat-up and quench be rapid. Direct or indirect quench can be used.

The quench material added directly into each reaction zone can be, broadly, any of a wide variety of gases or liquids that can be added quickly to the reactant mixture in order to cool the mixture below the effective reacting temperature while the mixture is in the reactor. Materials that are non-reactive with the reactant mixture are preferred, but many common materials can be used. These can include a portion of the recycled gas stream from the process (having components such as methane, ethane, propane), a portion of the produced liquid hydrocarbons, inert gases such as helium or argon, and even such materials as water, nitrogen and $CO_2$. Although these latter materials can react at the temperature found in the reactor, it is understood that these material can be added to the reactant stream, from the recycle gas stream, at such a temperature and in such volume so that the result is a quenching of the reactant stream, rather than additional reaction between the reactant stream and the quenched material. Hydrogen is thus the preferred quench material, with a process recycle stream rich in hydrogen being a natural extension of the preferred embodiment. Depending upon the reaction temperature and the mass flow through the reactor, a sufficient amount of quenching material, at a suitable temperature, is added to the reactant stream within each reaction zone so that the resultant mixture, near the exit of the reactor, has a temperature of about 200°–500° C. The temperature and the amount of quenched material added to each reaction zone are sufficient to quench the reaction mixture rapidly. The pressure of the entering quench material for the first reaction zone 12 is naturally higher than that of the pressure within the reactor. Desirably, the quench temperature for each reaction zone should be below the effective reacting temperature of the components, yet should be high enough to insure that the products of reaction in each reaction zone are in the vapor state, to facilitate downstream separation.

The weight ratio of quench material to product stream within each reaction zone is dependent upon such factors as the reaction temperature, components of product stream, excess of hydrogen, and other conditions. Quenching is a function of the sensible heat in the reaction mixture and in the quench stream.

After the quenched reaction mixture departs the last reaction zone 20 of the reactor 10, any unreacted solid material, such as ash or char, enters the char pot and is recovered therefrom, while the remainder of the effluent stream from each reaction zone, typically containing the product vapors, proceeds to downstream processing units, wherein product vapors in the gaseous stream are separated, and various contaminants, such as $NH_3$ and $H_2S$, can be removed from the gaseous stream, by methods familiar to those skilled in the art. A suitable fraction of the gas can be recycled for processing in the units found upstream of the reactor.

Typically, the major products from this process are char, light hydrocarbons, such as methane through $C_5$ hydrocarbons, and aromatics such as benzene, toluene, and xylene.

The hydrogen used in the process can be obtained from any commercial source, such as char gasification, naphtha and/or methane steam reforming, or cracking of ethane to produce ethylene. The steps of producing, storing, heating, cooling and recycling the hydrogen are well known and need not be discussed here. Reactor design, though an important consideration in terms of economics, is not an essential part of this invention. Any reactor design that will allow for the fast heatup of the feed carbonaceous material, a short reaction time, and a fast quench of the product stream within each reaction zone can be used for the invention.

Our invention will be illustrated by the following set forth examples which are given by way of illustration and not by any limitations. All parameters such as concentrations, mixing proportions, temperatures, pressures, rates, compounds, etc., submitted in these examples are not to be construed to unduly limit the scope of our improved process for short residence time hydropyrolysis of coal.

EXAMPLE 1

North Dakota lignite, ground to —100 mesh (U.S. Sieve), was fed to a hydrogenation reactor with 5 stages. The coal analyzed 10% $H_2O$ and 17% ash, on run-of-mine basis, and assayed 68.2% C, 5.5% H, 22.4% O, 1.5% N, and 2.4% S, on moisture-ash-free (MAF) basis. Hydrogen, heated to 1335° F. (724° C.), was added concurrently to each of the reaction zones of the reactor at a rate of 3.4 lbs. of hydrogen per lb. of feed coal. The reactor conditions were 1500 psig. and 1300° F. (705° C.). Residence time of this —100 mesh coal within each reaction zones in the reactor was approximately 16 seconds. The reaction mixture in each reaction zone was quenched by a stream of cold hydrogen (temperature = 150° C.), at a rate of 4.5 lbs. cold $H_2$/lb. feed coal. The temperature of the quenched mixture exiting the reactor was below 400° F. (below 204° C.). Processing and analysis of the total reactor effluent from all reaction zones, neglecting excess $H_2$, gave these results per ton of MAF feed coal;

| | | | |
|---|---|---|---|
| Benzene | 0.75 | bbl. | (with minor amounts of toluene and xylene) |
| 200–500° F. fraction | 0.48 | bbl. | |
| $CH_4$ | 8180 | SCF | |
| $C_2H_6$ | 2580 | SCF | |
| char | 545 | lbs. | |
| $H_2S$ | 45 | lbs. | |
| $NH_3$ | 25 | lbs. | |
| $H_2O$ | 350 | lbs. | |

-continued

| | |
|---|---|
| $CO_x$ | 225 lbs. |

EXAMPLE 2

Using a procedure similar to that of Example 1 and employing the following conditions, the following results can be obtained:

Wyoming Big Horn sub-bituminous coal, at —60 mesh (U.S. Sieve)

4.4% ash and 22.0% $H_2O$, run-of-mine basis assay-MAF basis:

72.6% C
4.8% H
20.8% O
1.3% N
0.5% S

Reactor conditions —3000 psig and 1450° F. (790° C) $H_2$ preheat temperature — 1550° F (840° C)

One lb. $H_2$ added/lb. feed coal

Coal residence time in each reaction zone for —60 mesh coal —500 milliseconds

Quench stream in each reaction zone — 2 lbs. $H_2$ (at—150° C.)/lb. feed coal

Temperature of exiting quenched mixture-below 400° F. (below 204° C.)

Products, per ton MAF feed coal, from all reaction zones:

| | | |
|---|---|---|
| Benzene | 3.0 bbl | (with minor amounts of toluene and xylene) |
| 200–800° F. fraction | 0.3 bbl | |
| $CH_4$ | 5300 SCF | |
| $C_2H_6$ | 1000 SCF | |
| Char | 278 lbs. | |
| $H_2S$ | 10 lbs. | |
| $NH_3$ | 29 lbs. | |
| $H_2O$ | 300 lbs. | |
| $CO_x$ | 220 lbs. | |

EXAMPLE 3

Using the procedure of Example 1 and the following conditions, the following results can be obtained:

Wyoming Glenrock coal, ground to —200 mesh

25% $H_2O$ and 13.5% ash—ROM basis MAF assay —

70.1C
5.5% H
22.7% O
1.0% N
0.7% S

Reactor conditions — 600 psig and 930° F.(500° C)

$H_2$ preheat temperature — 1050° F. (565° C.) 0.5 lb. $H_2$ added/lb. feed coal Coal residence time in each reaction zone for —200 mesh coal — 150 milliseconds Quench Stream in each reaction zone — —0.5 lb. $H_2$ (—150° C.)/lb. feed coal Quench exit temperature — 450° F. (232° C.)

Products (per ton of MAF coal) from all reaction zones

Benzene (plus toluene and xylene) 1.1 bbl

| | |
|---|---|
| Benzene (plus toluene and xylene) | 1.1 bbl |
| 200–1000° F. fraction | 0.3 bbl |
| $C_1$–$C_2$ fraction | 2900 SCF |
| Char | 1000 lbs. |

-continued

| | |
|---|---|
| $H_2S$, $NH_3$, $H_2O$, $CO_x$ | 560 lbs. |

EXAMPLE 4

Using a procedure similar to that of Example 1 and employing the following conditions, these results can be obtained:

Kentucky No. 11 bituminous coal, ground to —40 mesh

5% $H_2O$ and 6% ash — ROM basis

Assay — MAF basis 79.2% C
5.6% H
9.6% O
1.5% N
4.1% S

Reactor conditions — 4000 psig and 2730° F. (1500° C)

$H_2$ preheat temperature — 2790° F. (1530° C) 7 lbs. $H_2$ added/lb. feed coal

Coal residence time in each reaction zone for —40 mesh coal — 10 milliseconds

Quench Stream in each section zone — 25 lbs. $H_2$ (—140° C)/lb. feed coal

Exit quench temperature — 380° F. (193° C.)

Products, per ton MAF feed coal from all reaction zones:

| | |
|---|---|
| BTX mixture | 2.6 bbl. |
| 200°–500° F. fraction | 0.3 bbl. |
| $C_1$–$C_2$ | 12,000 SCF |
| Char | 180 lbs. |
| $H_2S$, $NH_3$, $H_2O$, $CO_x$ | 500 lbs. |

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

We claim:

1. A process for treating carbonaceous material with hydrogen, in the absence of added catalyst, comprising, in serial combination, a. adding liquid or crushed solid carbonaceous material into a first reaction zone of a reactor having at least two reaction zones;

b. adding hot hydrogen to the stream of carbonaceous material to effect a reaction with same at a carbonaceous material heating rate of between about 500° C/second and about 100,000° C/second, a temperature of between about 400° and 2000° C and a pressure of between 500 and 5000 psig;

c. quenching the mixture of step b) while insuring that the total residence time of steps b) and c) varies from about 2 milliseconds to about 2 seconds;

d. removing at least a portion of the reaction products from said quenched mixture of step c); and e. introducing the residual carbonaceous material into a subsequent reaction zone and repeating steps (a)–(d) for said subsequent reaction zone.

2. The process of claim 1, wherein the crushed solid material has an average particle size smaller than about one-half inch.

3. The process of claim 2, wherein the ratio of carbonaceous material to hydrogen, in the carbonaceous material-hydrogen mixture in each of said reaction zones varies from about 0.05 to about 4.

4. The process of claim 3, wherein the temperature of the quenched mixture in each reaction zone does not exceed about 200° C.

5. The process of claim 4, wherein the quenching material is hydrogen at a temperature below 200° C. and the carbonaceous material is coal.

6. The process of claim 5 wherein said reaction zones are superimposed with respect to each other.

7. The process of claim 6 wherein said reaction products are removed from the surface of the carbonaceous material.

8. The process of claim 7 wherein said reactor includes five reaction zones and said carbonaceous material is gravity fed through each of said reaction zones.

9. A process for converting coal into fluid hydrocarbons comprising the steps of:

a. Introducing a continuous stream of finely divided coal into a first reaction zone of a pressure vessel having at least two reaction zones;

b. continuously adding hot hydrogen to the first reaction zone of the pressure vessel so as to impinge the coal stream and effect a reaction with same to produce fluid hydrocarbon reaction products with a pressure of between 500 and 5000 psig and a temperature of between about 400° and about 2000° C;

c. subsequently quenching the hot hydrogencoal stream within the first reaction zone with cold hydrogen while insuring the total residence time for steps b) and c) varies from about 2 milliseconds and about 2 seconds;

d. removing at least a portion of the fluid hydrocarbons from the quenched hydrocarboncoal stream; and e. introducing the residual coal into a subsequent reaction zone and repeating the steps (a) – (e) for the subsequent reaction zone.

10. The method of claim 9, wherein a. The coal has an average particle size of less than about one-half inch;

b. the hydrogen/coal weight ratio of the reaction mixture in each reaction zone varies from about 0.05 to about 4;

c. the reaction temperature varies from about 500° to about 1500° C.;

d. the reaction pressure varies from about 600 to about 4000 psig;

e. the total residence time of hydrogen and coal in each reaction zone is not more than about 1 second;

f. the cold hydrogen quenched stream has a temperature of below about 500° C; and g. the separated liquid hydrocarbon steam is further processed.

11. The method of claim 9, wherein the separated fluid hydrocarbons are further processed.

* * * * *